United States Patent [19]

Goettl

[11] 4,192,832

[45] Mar. 11, 1980

[54] AUTOMATIC FLUSHING AND DRAINING RESERVOIR APPARATUS FOR EVAPORATIVE COOLERS

[76] Inventor: Adam D. Goettl, 4960 E. Palomino Rd., Phoenix, Ariz. 85018

[21] Appl. No.: 7,027

[22] Filed: Jan. 29, 1979

[51] Int. Cl.[2] ..... B01F 3/04

[52] U.S. Cl. ..... 261/36 R; 261/70; 261/DIG. 46

[58] Field of Search ..... 261/28, 29, 36 R, 70, 261/DIG. 4, DIG. 46

[56] References Cited

U.S. PATENT DOCUMENTS

| | | | |
|---|---|---|---|
| 1,950,345 | 3/1934 | Williams | 261/28 |
| 2,646,061 | 7/1953 | Bottum | 261/DIG. 46 |
| 2,828,761 | 4/1958 | Weibert, Jr. | 261/36 R X |
| 2,856,166 | 10/1958 | Goettl | 261/29 |
| 3,314,080 | 4/1967 | Shilling, Jr. | 261/DIG. 46 |
| 3,476,673 | 11/1969 | Stiles | 261/DIG. 46 |
| 3,606,982 | 9/1971 | Anderson | 261/29 |
| 3,643,930 | 2/1972 | Schulze, Sr. | 261/DIG. 46 |
| 3,754,741 | 8/1973 | Whitehurst | 261/DIG. 46 |
| 4,129,140 | 12/1978 | Carlin | 261/DIG. 46 |

*Primary Examiner*—Richard L. Chiesa
*Attorney, Agent, or Firm*—Herbert E. Haynes, Jr.

[57] ABSTRACT

A pump, siphon drain valve and float controlled water inlet valve are located in a comparatively small water supply tank which is mounted below an opening formed in the floor pan of an evaporative cooler to locate the cooler's water supply externally of its cabinet and are operative to recirculatingly supply water to the cooler and receive the returning water. The water, which increases in mineral concentration during such recirculation, is periodically drained from the tank by shutting off the pump so that the returning water will elevate the water level in the tank to prime the siphon drain valve. When the pump and water inlet supply are both shut off, the tank completely drains, and when the pump alone is shut off, tank draining, flushing and refilling is accomplished.

11 Claims, 7 Drawing Figures

AUTOMATIC FLUSHING AND DRAINING RESERVOIR APPARATUS FOR EVAPORATIVE COOLERS

BACKGROUND OF THE INVENTION

1. Field of the Invention

This invention relates to evaporative coolers and more particularly to an improved automatic flushing and draining reservoir apparatus for use with evaporative coolers.

2. Description of the Prior Art

Evaporative coolers of the type having an air handler mounted in a cabinet for drawing air into the cooler through wettable cooler pads and delivering the evaporatively cooled air to a point of use, have the necessary water supply contained within a floor pan or sump. The water level within the sump is maintained at a predetermined level by a float controlled inlet valve that is suitably connected to a source of water under pressure such as a domestic water line. A pump is mounted in the sump and operates to supply water to the cooler's water distribution system which in turn distributes the water to the cooler pads. The wet cooler pads will cool the air being drawn therethrough by the air handler in accordance with the well-known evaporation principle, and the unevaporated water will drain under the influence of gravity from the pads and return to the sump.

During such operation, the water, which inherently contains minerals such as calcium chloride and other impurities, will increase as to its concentrations of those minerals due to the evaporation process. As the mineral concentration increases, the rate of precipitation will also increase which results in mineral deposition, or scaling, of the various cooler components. Such mineral deposition causes calcification of the cooler pads, clogging of water passages, corrosion of the metal and the like, but the most serious problem is with the electric motors and wiring. When the calcium chloride salts are deposited on the wiring, terminals, and the various parts of the electric motors themselves, moisture in the cooler is attracted to the salts and will form a moist pasty salt substance which shorts out those electric components. To keep such mineral deposition to a minimum, the cooler should be periodically drained, flushed and refilled with fresh water. However, since this draining, flushing and refilling is something which should be accomplished on a regular and rather frequent schedule, as determined by the character of the water, it is something that is almost always forgotten or completely ignored.

The above described problem of mineral deposition is compounded by the fact that the water is stored within the sump which serves as a reservoir. Thus the various cooler components are continuously subjected to a moist environment by being directly exposed to a relatively large water body in the bottom of its cabinet. Unless the sump is drained at the end of a cooling season, or other period of nonuse, such direct exposure of the components to the water body is something that can, and often is, continuous whether the cooler is operating or not. Draining of the sump preparatory to a period of nonuse is no guarantee that the sump will remain dry for the period of nonuse in that leakage from the inlet supply line or rain entering the cooler cabinet through the pads will collect in the sump.

The above described problems and shortcomings of prior art evaporative coolers is something that has long been recognized and various attempts have been made to solve, or at least minimize, some of those problems. For example, devices which dispense chemicals into the water to reduce the mineral concentration and deposition problems have been suggested, however, such devices have not received commercial acceptance due to the minimal benefits derived, cost, and maintenance requirements.

One particular prior art device has been suggested in U.S. Pat. No. 2,828,761, for automatically draining, flushing, and replacing the water in a cooler's sump and for draining a large portion of the water therefrom when the inlet water supply to the sump is shut off. Briefly, this prior art device includes a sheet metal dam which is located within the sump of the cooler. A one-way check valve is located in the wall of the dam so that water is free to flow from the main reservoir portion of the sump into the relatively smaller dam portion but is prevented from flowing in a reverse direction. A pump and siphon valve are located inside the dam and a float controlled water inlet valve is located in the main reservoir portion of the sump to maintain the water level in the sump and in the dam, due to the free flow through the check valve, at a predetermined level. During operation of the cooler, the pump delivers the water from the dam portion of the cooler's water distribution system which in turn supplies the water to the cooler pads, and the unevaporated water will return from the pads, by gravity to the main reservoir portion of the sump. When the pump is turned off, water in the cooler's water distribution system will drain back into the dam area only, due to the reverse flow checking provided by the check valve, thus raising the water level therein to a point where it primes the siphon valve. When the siphon valve is thus primed, water in the dam will be drained therefrom and the water in the main reservoir portion of the sump will flow through the check valve into the dam and will exit the dam through the siphon valve. When the water supply is left on during such an operation, the result is that a draining, flushing and water replacement action takes place, and due to the outlet and siphon valve being sized to drain the sump at a faster rate than the water inlet line can replace the water, the water level will drop until the siphon valve loses its prime, whereupon refilling of the sump with fresh water takes place under control of the float operated water inlet valve. This same operation occurring when the water supply to the cooler is shut off results in draining of most of the water from the sump.

This particular prior art flushing and draining device has not received commercial acceptance for several reasons. In the first place, the amount of water contained in the water distribution system of an evaporative cooler is quite small and will, in most cases, be insufficient to achieve priming of the siphon valve. Secondly, the check valve of this prior art structure is a constant source of problems in that the water pressure differential on the opposite sides thereof is all that can be relied upon for opening and closing of the valve, and that pressure differential is very small. The small pressure differential relied on to open and close the check valve precludes the use of a spring or other device to bias the valve toward its closed position. Therefore, the check valve is a passive rather than a positively acting device, and achieving a fully closed position when such a state is critical is oftentimes not achieved. To illustrate the point, there can be no leakage through the check valve when the draining cycle is initiated in that such leakage would prevent the water level in the dam from reaching the point where the siphon valve is primed. In addition to the passive action of the check valve, it, by necessity, is operated underwater and this subjects the valve to corrosion, scaling and the like, and the valve often is jammed by foreign matter such as dirt, wood shavings from the excelsior pads and the like. Thirdly, this prior art device is incapable of completely draining all of the water from the dam and the main reservoir portion of the sump in that both the check valve and the inlet to the siphon valve are spaced upwardly from the bottom of the sump. Therefore, the desirability of draining the sump when the cooler is inoperative cannot be completely achieved and a relatively large surface area of water will remain. Further, when the pump is shut off to accomplish a draining, flushing and water replacement cycle, water will not be supplied to the cooler pads for a considerable length of time due to the amount of water that must be drained and replaced to fill the entire relatively large sump before normal operation can be resumed. Since warm air will continue to be drawn through the pads by the air handler during such a cycle, the pads will dry out rather rapidly and upon drying, dust, dirt and the like will be extracted from the pads by the air moving therethrough.

In addition to the inherent problems of this particular prior art structure, it does nothing to remove the cooler components from direct exposure to the water in the sump either during operation or during nonuse of the evaporative cooler, and is incapable of automatically draining rain water or the like which enters the cooler during nonuse periods.

Therefore, a need exists for a new and improved automatic flushing and draining reservoir apparatus for evaporative coolers which overcomes some of the problems and shortcomings of the prior art.

SUMMARY OF THE INVENTION

In accordance with the present invention a new and improved automatic flushing and draining reservoir apparatus for evaporative coolers is disclosed. The reservoir apparatus includes a tank for attachment to the floor pan of the evaporative cooler so as to be located immediately below an opening formed through the floor pan. A pump, siphon valve, and float controlled water inlet valve are mounted in the tank with the pump being used to supply water to the cooler's water distribution system, the siphon valve being used during the flushing and draining operations, and the float controlled water inlet valve operating to maintain the water level in the tank at a predetermined operating level.

In operation, the reservoir apparatus of the present invention will deliver water from the tank to the cooler's water distribution system which directs the water to the cooler's pads. Unevaporated water from the cooler pads returns by gravity into the floor pan of the cooler and will pass through the opening thereof into the tank. When the pump is turned off, and the inlet water supply is left on, water returning from the cooler pads will add to the water that drains from the water distribution system to raise the water level in the tank to a flooded level which primes the siphon valve. Such priming of the siphon valve will drain the tank. The flow capacity of the siphon valve is considerably larger than the flow capacity of the inlet water supply line, thus, during draining of the tank fresh water will continuously enter and dilute the water that is being drained. Such diluting will dissolve some of the minerals which were previously precipitated and they will exit the tank during the draining. When the draining is complete, the siphon valve will lose its prime and the float controlled water inlet valve will refill the tank with fresh water. When both the pump and inlet water supply line are shut off, the siphon valve will be primed in the above described manner and the tank will be completely drained and will remain that way due to the inlet water supply being shut off.

The tank may be provided with a collection trough, having a controlled drainage flow, with the trough being adapted for catching and maintaining a predetermined quantity of the unevaporated water returning from the cooler pads so that this water will always be present for priming of the siphon valve.

The tank contains an amount of water that is sufficient for operation of the evaporative cooler, and is configured to present a relatively small surface area. The amount of returning water needed to effect priming of the siphon valve is minimal due to the relatively small surface area of the tank, and since both the water returning from the cooler pads and that draining from the cooler's water distribution system are employed to achieve the desired priming of the siphon valve, a sufficient quantity of water is always available to accomplish that task.

By locating the tank below the floor pan of the cooler, water will never stand in the floor pan which reduces scaling and corrosion of the pan itself and the other cooler components, and will also reduce the cooler's direct exposure to a water body having a relatively large surface area. Even further reduction of such direct exposure of the cooler is achieved by providing the tank with a cover that is spaced immediately above the opening formed through the cooler's floor pan. This same mounting of the reservoir tank below the floor pan eliminates the need for a flow checking valve as in the hereinbefore described prior art structure thus eliminating, or substantially reducing, the possibility of scaling, corrosion, or contamination causing the reservoir apparatus to become inoperative.

In the reservoir of the present invention, the inlet to the siphoning valve is located in a downwardly upset dimple, or depression, formed in the bottom of the tank so that the inlet is below the bottom of the tank. This, in conjunction with the lack of a check valve, allows complete and automatic drainage of the water from the cooler and the reservoir when both the pump and the water supply line are shut off.

Other advantages, both from manufacturing and aesthetic standpoints, results from the reservoir apparatus of the present invention. Since the water supply, pump, and float controlled inlet valve are no longer contained within the cooler cabinet itself, the over-all height of the cabinet can be reduced which results in a more aesthetically appealing low profile structure, and a substantial savings of material is achieved. Further, the depth of the floor pan can be reduced in that it no longer serves as a reservoir, thus, the floor pan can be the same as the roof pan which results in savings from the standpoints of tooling, material handling and the like.

Accordingly, it is an object of the present invention to provide a new and improved automatic flushing and draining reservoir apparatus for use with evaporative coolers.

Another object of the present invention is to provide a new and improved reservoir apparatus of the above described character which reduces the scaling, calcification, and corrosion of the cooler by automatically draining, flushing and replacing the cooler's water supply each time the cooler's pump is shut off.

Another object of the present invention is to provide a new and improved reservoir apparatus of the above described character which will completely drain all the water from the cooler and the reservoir when the pump and the inlet water supply are shut off.

Another object of the present invention is to provide a new and improved reservoir apparatus for the above described type which removes the water supply from the sump, or floor pan, of the evaporative cooler and locates it in a more remote location which reduces scaling, calcification, corrosion and direct exposure of the cooler to a water body having a relatively large surface area.

Another object of the present invention is to provide a new and improved reservoir apparatus of the above described character which will not add any mechanisms having moving parts that could contribute to failure of the apparatus.

Another object of the present invention is to provide a new and improved reservoir apparatus of the above described character which includes a tank that is mounted below an opening in the cooler's floor pan for containing the cooler's water supply, and receiving the unevaporated water returning from the cooler.

Another object of the present invention is to provide a new and improved reservoir apparatus of the above described type in which the water level in the tank is maintained at a predetermined level by a float controlled water inlet valve mounted therein.

Another object of the present invention is to provide a new and improved reservoir apparatus of the above described character in which water returning from the cooler's pads and water draining from the cooler's water distribution system upon shutting off of the pump, will raise the water level in the tank to prime a siphon valve mounted therein to cause complete drainage of the tank.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
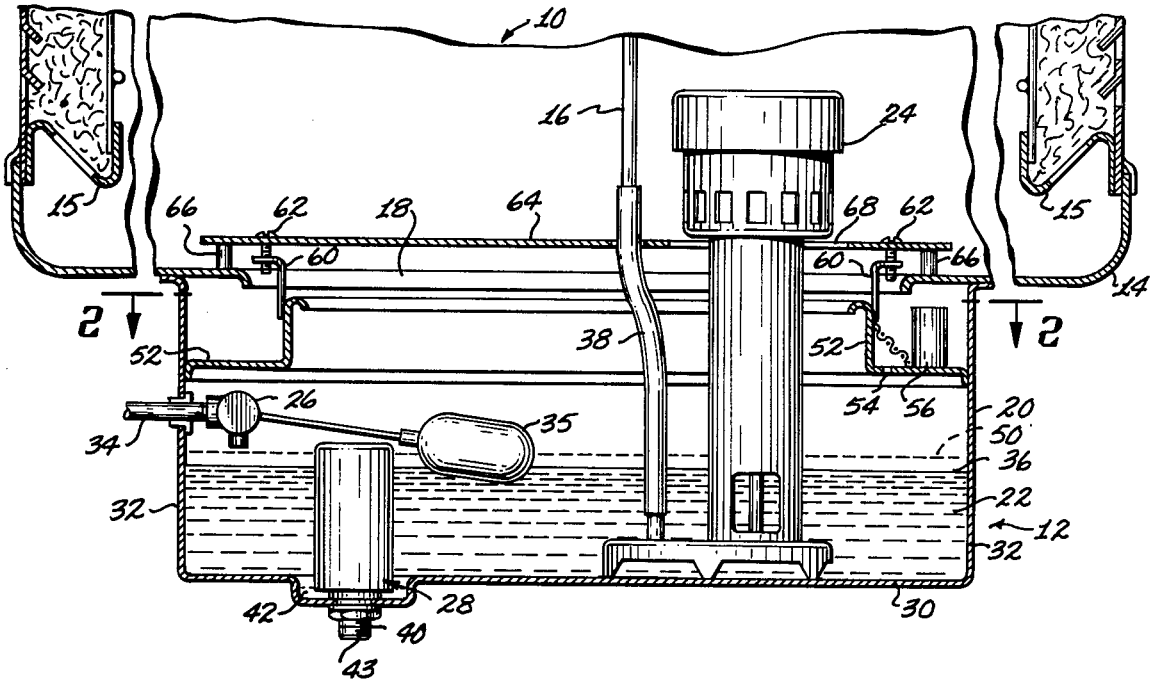
FIG. 1 is a fragmentary sectional view of a typical evaporative cooler having the automatic flushing and draining reservoir apparatus of the present invention mounted thereon.

Referring more particularly to the drawings, FIG. 1 shows a fragmentary portion of a typical evaporative cooler, which is indicated generally by the reference numeral 10, to which is attached the automatic flushing and draining reservoir apparatus of the present invention, with that apparatus being indicated in its entirety by the reference numeral 12.

The evaporative cooler 10, includes among other things, a floor pan 14 wettable cooler pads 15, and a water distribution plumbing system or network 16. Since evaporative coolers are well-known in the art, it is not deemed necessary to completely illustrate such a structure and only a brief description of operation will be given to facilitate understanding of the reservoir apparatus of the present invention.

Typically, water under pressure is supplied to the plumbing system 16 which carries the water to the upper portion of the cooler's cabinet and distributes it to the top of each of the cooler pads 15. The cooler pads are thus wetted so that air being drawn into the cabinet through the pads by means of a suitable air handler such as a centrifugal blower, (not shown), will be cooled by evaporation. Some of the water trickling down through the cooler pads 15 will, of course, evaporate and the remaining unevaporated water will drain into the floor pan 14.

In accordance with the present invention, the floor pan 14 of the evaporative cooler 10 is formed with an opening 18 so that the unevaporated water draining from the cooler pads 15 will pass through the opening 18 into the automatic draining and flushing reservoir apparatus 12 of the present invention.

As will hereinafter be described in detail, the automatic flushing and draining reservoir apparatus 12 of the present invention, includes the major components of a tank 20 for containing water 22 that is used in operation of the cooler 10, a pump 24 for supplying the water 22 to the cooler, a float controlled shutoff valve 26 for initially supplying the water 22 to the tank and periodically supplying makeup water thereto, and a siphon drain valve 28 which is employed for draining purposes.

Figure 2:
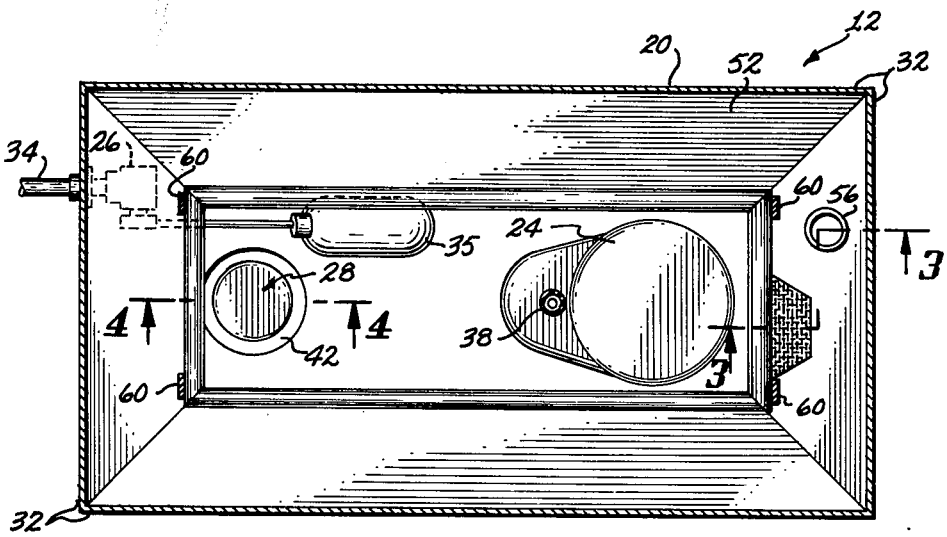
FIG. 2 is a sectional view taken on the line 2—2 of FIG. 1.

As seen in FIGS. 1 and 2, the tank 20 is an upwardly opening structure having a bottom wall 30 with integral upstanding sidewalls 32. The tank may be of any convenient configuration, such as the rectangular shape shown, and is mounted to the bottom of the floor pan 14 immediately below the opening 18 formed therethrough as will hereinafter be described in detail. With regard to size, the tank 20 is formed with a depth dimension sufficient to contain an amount of water 22 for proper operation of the cooler 10, with that amount being determined by the size of the cooler, pumping capacity of the pump 24, and the like. The area of tank 20 is to be as small as possible for reasons which will become apparent as this description progresses. A water supply line 34 passes through one of the sidewalls 32 of the tank 20 and has the float controlled shutoff valve 26 threadingly or otherwise attached to its outlet end. The opposite end (not shown) of the water supply pipeline 34 is connected to a suitable source of water under pressure such as a domestic water line. In this manner, the water 22 will be initially supplied to the tank 20 and thereafter will be periodically opened under control of the float 35, to supply makeup water thereto and thus maintain the water level at a predetermined normal operating level 36.

The pump 24 may be of any suitable type which will pump the water 22 from the tank 20 through the pump outlet hose 38 to the water distribution plumbing network 16 of the evaporative cooler 10.

Figure 4:
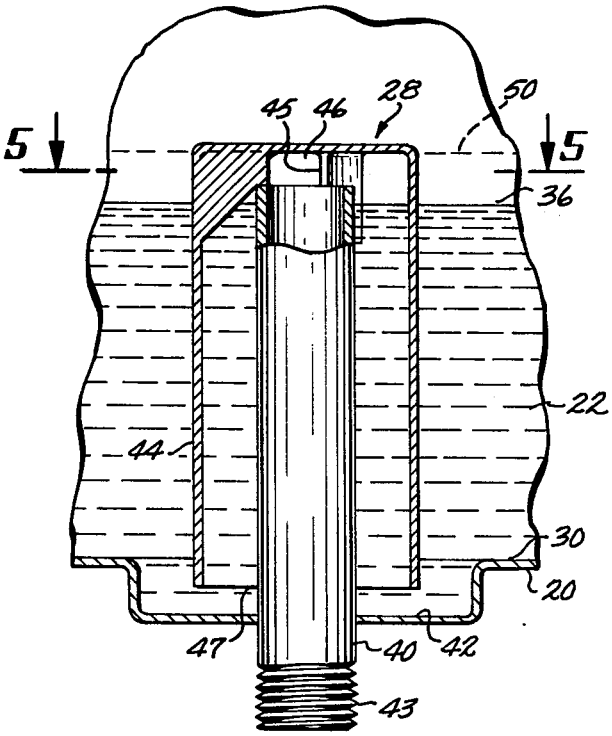
FIG. 4 is an enlarged fragmentary sectional view taken along line 4—4 of FIG. 2.

The siphon drain valve 28 as seen in FIG. 4, includes a standpipe 40 that is mounted in a downwardly upset dimple or depression 42 formed in the bottom wall 30 of the tank 20. The bottom end of the standpipe 40 passes through the bottom of the depression 42 and is provided with threads 43 by which a hose (not shown) or other disposal means may be connected thereto. A cylindrical cap 44 is coaxially demountably mounted on the standpipe 40 and is provided with internal webs 45 in the upper closed top portion thereof. The webs are designed to engage the upper end of the standpipe 40 for mounting purposes and to provide an open water passage zone 46 between the top of the standpipe 40 and the closed top end of the cap 44, with the zone 46 being located above the normal water level 36 in the tank 20. The cap 44 is provided with an elongated skirt portion which has a bottom edge 47 that is located within the depression 42. Locating the bottom edge 47 of the cap in the depression 42, and locating the open zone 46 immediately above the normal operation water level 36 will herein after be described in detail.

In normal operation of the evaporative cooler 10, water under pressure is initially supplied to the tank 20 through the float control valve 26 to achieve the normal operating level 36, and the float controlled valve will periodically open to supply makeup water to replace that lost by evaporation. The pump 24 will deliver the water 22 to the distribution plumbing network 16 of the cooler 10, which wets the cooler pads 15 as hereinbefore described. The unevaporated water drainage from the pads 15 will return to the tank 20 through the opening 18 in the floor pan 14 of the cooler, and recirculation of the water will continue as long as no externally applied interrupting force is applied.

The water 22 in the tank 20 will become increasingly contaminated with dirt and the concentration of minerals will increase during the above described normal operation of the cooler 10, and periodic flushing and replacement of the water is desirable to prolong the life of the cooler. Periodic flushing may be accomplished by simply shutting off the power to the pump 24 which allows the water in the cooler's plumbing network 16 to drain back into the tank 20, which in conjunction with the unevaporated water draining from the cooler pads 15, will raise the water level in the tank 20 from its normal level 36 to a flooded level 50 which is shown in dotted lines in FIGS. 1 and 4. When the water 22 reaches the flooded level 50, the zone 46 will be underwater which results in priming of the siphon valve 28. With the siphon valve 28 primed, the water 22 will be drained from the tank 20. It will be noted that the size of the standpipe 40 is considerably larger in diameter than the water supply line 34, therefore, the rate at which the tank 20 is drained is considerably faster than the incoming rate of fresh water supplied through the float controlled shutoff valve 26. In this manner, a flushing action will take place and when the drainage is complete, the siphon valve 28 will lose its prime and fresh water will fill the tank 20 to the operating level 36 and normal operation of the evaporative cooler 10 may be resumed.

The above described flushing and water replacement operation should be accomplished at periodic intervals during operation of the evaporative cooler 10 as hereinbefore mentioned. When operation of the cooler is to be terminated, such as at the end of a cooling season, or at other times of prolonged nonuse, shutting off of the power to the pump 24 and shutting off of the water supply to the tank 20 will completely drain the tank. Complete drainage is desirable so that the cooler 10 will not contain a standing body of water during periods of nonuse. It will be noted that positioning of the bottom edge 47 of the cap 44 within the depression 42 formed in the bottom of the tank 20, will cause complete drainage of the tank's bottom and only a relatively small amount of water will remain within the depression 42.

In the preferred embodiment, the tank 20 includes an endless water collection trough 52 which is affixed, such as by welding, to the upper ends of the interior surfaces of the tank's sidewalls 32. The trough 52 is configured and sized so as to catch all of the unevaporated water that passes downwardly through the opening 18 in the floor pan 14. As seen best in FIG. 3, the trough 52 is provided with an aperture 54 in the bottom thereof and an overflow pipe 56. The purpose of the trough 53 is to collect the returning uneavporated water and control the flow of that water into the bottom of the tank. The size of the aperture 54 is such that the outflow from the trough 52 will be slower than the rate of inflow thereto so that the trough 52 will fill to a level determined by the position of the top of the overflow pipe 56, and a constant outflow from the trough 52 will take place during normal operation of the cooler 10. During the above described flushing and/or complete draining operations, the constant outflow from the trough 52 will continue for a period of time after initiation of either of those operations. This feature insures that there will always be a sufficient amount of water to raise the level in the tank to the flooded level 50 upon initiation of either the flushing or the complete draining operations. In most evaporative coolers, the trough 52 will not be needed, however, in some instances, such as in coolers having relatively small water distribution plumbing networks, and in exceptionally dry regions where the evaporation rate is high, the troughs will insure proper operation of the reservoir device 12 of the present invention.

Figure 3:
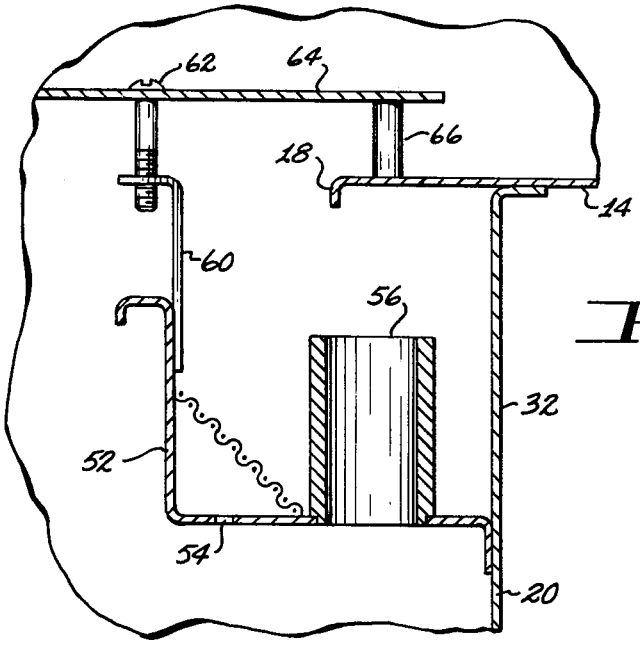
FIG. 3 is an enlarged fragmentary sectional view taken along the line 3—3 of FIG. 2.
Figure 5:
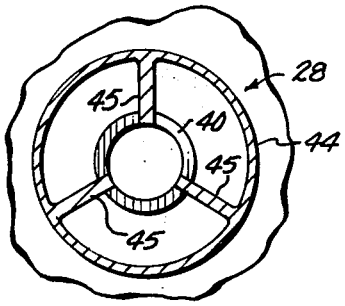
FIG. 5 is a sectional view taken along the line 5—5 of FIG. 4.

Mounting of the automatic flushing and draining reservoir apparatus 12 on the cooler 10 may be accomplished in a number of suitable manners, such as that shown in FIGS. 1 and 3. In this preferred embodiment, a plurality of L-shaped brackets 60 are affixed to the endless trough 52 so as to extend upwardly therefrom toward the opening 18 formed in the cooler's floor pan 14. A plurality of fasteners 62, such as the screws shown, are mounted in a planar cover member 64 and extend downwardly therefrom into threaded engagement with suitably tapped holes provided in the L-shaped brackets 60. The cover 64 is configured to overlay the opening 18 provided in the floor pan 14, and is somewhat larger than the opening. A plurality of spacers 66 are suitably affixed to the downwardly facing surface of the cover 64 adjacent the periphery thereof with those spacers being in resting engagement with the upwardly facing surface of the floor pan 14. Thus, the cover rests on top of the floor pan 14 in spaced relationship above the opening 18, and the tank is suspendingly mounted from the cover 64 by means of the screws 62 and brackets 60 so as to be in bearing engagement with the bottom surface of the floor pan 14.

In addition to suspendingly mounting the tank 20, the cover 64 serves to shield the interior of the evaporative cooler 10, and its components, from direct exposure to the water 22 within the tank 20, and this reduces the moisture content and mineral deposition within the cooler.

It will be noted that the cover 64 is provided with an opening 68 formed therethrough, and the pump 24 extends upwardly from the tank 20 through that opening so that the motor of the pump is located within the cooler rather than within the tank 20. This will isolate the pump's motor as much as possible from the damaging effects of moisture and mineral deposition.

It will be further noted that the pump 24 need not be located within the tank 20 at all, in that the same results could be obtained by mounting of a suitable pump (not shown) on the side of the tank, or at any other remote location, and supplying water thereto by suitable plumbing lines.

The above described automatic flushing and draining reservoir apparatus 12 of the present invention is automatic only to the extent that it will automatically flush, or drain in response to the pump 24 being shut off and such will, in most instances, be accomplished manually. A fully automatic system can be employed such as those shown in FIGS. 6 and 7 and as will not be described in detail.

Figure 6:
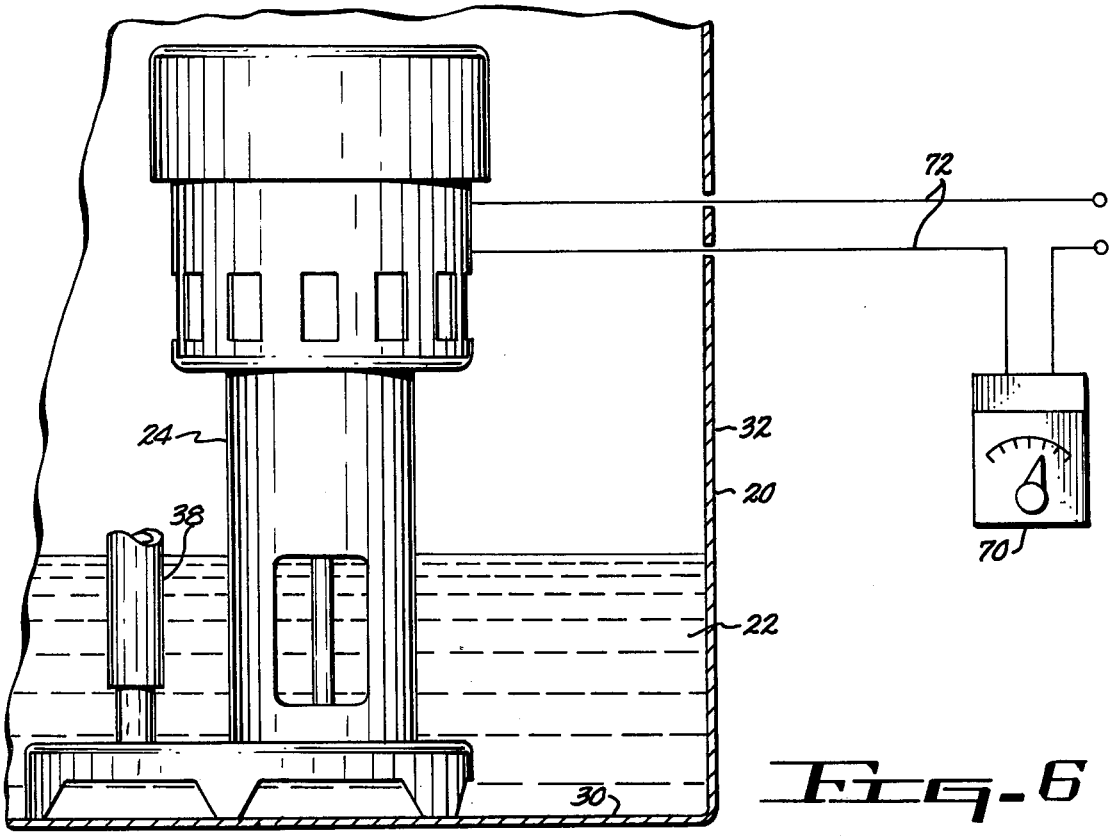
FIG. 6 is a fragmentary sectional view of the reservoir apparatus of the present invention which schematically shows a first means for automatically and periodically switching the apparatus of the present invention into a draining, flushing and water replacing operational mode.

In FIG. 6 a suitable normally closed timing and delay device 70 is mounted in the power supply line 72 leading to the pump 24, and at predetermined intervals, such as 24 hours, the timing and delay device 70 will open the power line 72 leading to the pump 24. Such interruption will start the flushing operation and the delaying function accomplished by the timing and delay mechanism 70 will continue such interruption for a sufficient length of time to allow the completion of the flushing operation.

Figure 7:
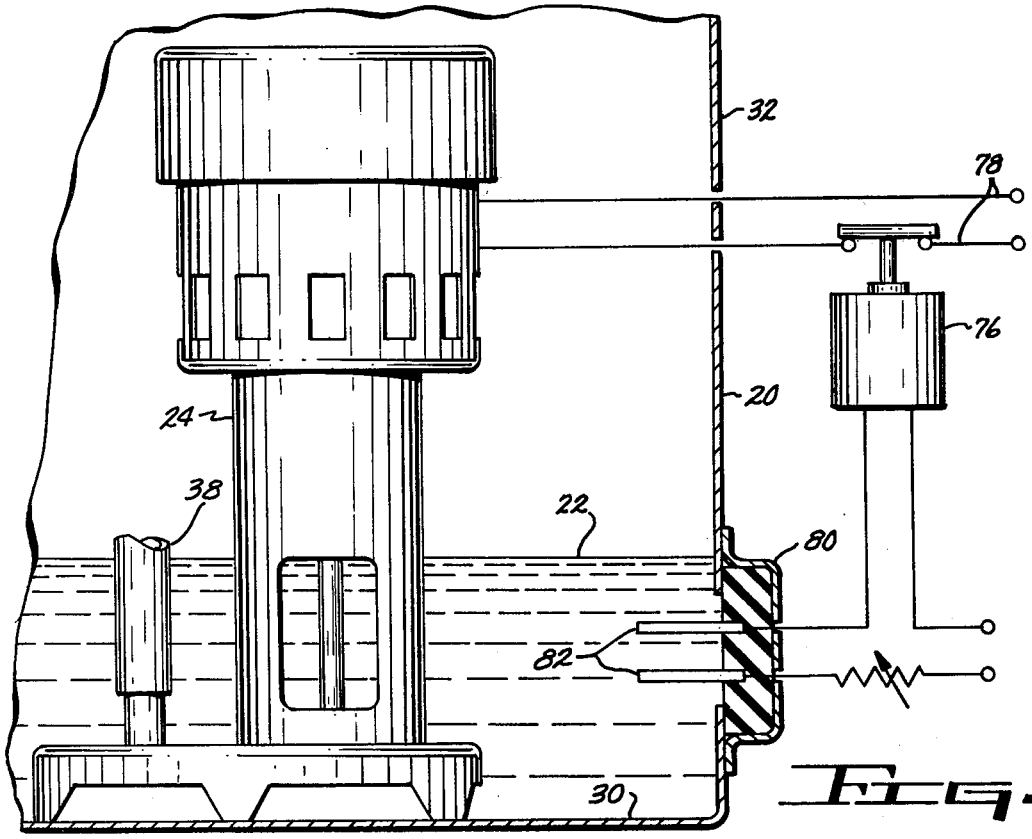
FIG. 7 is a view similar to FIG. 6 and schematically illustrating a second means for automatically and periodically switching the apparatus of the present invention into a draining, flushing and water replacing operational mode.

In FIG. 7, a normally closed solonoid 76 is mounted in the power supply line 78 of the solonoid 76 and energization of the solonoid is controlled by a conductivity sensing mechanism 80. When the water 22 in the tank is relatively fresh, i.e., having a relatively low concentration of dissolved minerals, the water will act as an electrical insulator so that no current will flow between the probes 82 of the sensing mechanism 80. When the concentration of minerals increases in the water, which will occur as hereinbefore described, to a point where the water is sufficiently conductive, current will flow between the probes and the solonoid 76 will be energized thus, interrupting power to the pump 24.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An automatic flushing and draining reservoir for an evaporative cooler comprising:

(a) an evaporative cooler including a water distribution plumbing system for carrying water to the upper portion of said cooler and a floor pan for receiving unevaporated water draining by gravity from the upper portion of said cooler, the floor pan of said cooler having an opening formed therethrough;

(b) a tank mounted on the bottom of said cooler below the opening of the floor pan thereof for receiving the unevaporated water from the floor pan;

(c) means for supplying water from an external source to said tank and maintaining it at a predetermined operating level therein;

(d) pump means for pumping water from said tank into the distribution plumbing system of said cooler and allowing the pumped water in the distribution plumbing system to drain back by gravity into said tank upon interruption of the operation of said pump means so that this returning pumped water in conjunction with the unevaporated water received from the floor pan of said cooler will cause the water level in said tank to raise from the operating level to a flooded level;

(e) a siphon drain valve mounted in said tank with its inlet adjacent the bottom thereof and having an elevated water passage zone located between the water operating level and the flooded water level of said tank so that its siphoning action will be initiated upon the water level in said tank reaching the flooded level, said siphon drain valve including, I. a standpipe mounted in the bottom of said tank and having an open upper end, and II. a cylindrical cap having a closed upper end and an inside diameter which is larger than the outside diameter of said standpipe, said cap mounted coaxially on said standpipe with the closed upper end of said cap spaced above the upper end of said standpipe to define the elevated water passage; and (f) said tank being sized to contain said means for supplying water, said pump means, said siphon drain valve and hold a sufficient amount of water for proper operation of said evaporative cooler as determined by the size of said evaporative cooler.

2. An automatic flushing and draining reservoir as claimed in claim 1 and further comprising a downwardly upset depression formed in the bottom of said tank with the inlet of said siphon drain valve located within said depression below the bottom of said tank.

3. An automatic flushing and draining reservoir as claimed in claim 1 and further comprising a cover positioned in the floor pan of said cooler in upwardly spaced overlaying relationship with the opening formed through said floor pan.

4. An automatic flushing and draining reservoir as claimed in claim 1 and further comprising an endless trough mounted in said tank adjacent the top thereof for receiving the unevaporated water from the floor pan of said cooler, said trough having an overflow means therein for maintaining the received water at a predetermined level and having an aperture for controlling the flow of the received water into the bottom of said tank.

5. An automatic flushing and draining reservoir as claimed in claim 1 and further comprising:

(a) said tank being an upwardly opening structure having a bottom with integral upstanding sidewalls;

(b) a cover positioned in the floor pan of said cooler in overlaying relationship with the opening formed therethrough;

(c) spacer means depending from said cover into bearing engagement with the upper surface of the floor pan of said cooler to position said cover in upwardly spaced relationship with respect thereto; and (d) means demountably extending between said cover and said tank for suspendingly mounting said tank from said cover with the upper edges of the sidewalls of said tank in bearing engagement with the bottom surface of the floor pan of said cooler.

6. An automatic flushing and draining reservoir as claimed in claim 1 wherein said means for supplying water comprises:

(a) a water supply line having its outlet end within said tank; and (b) a float controlled shutoff valve mounted on the outlet end of said water supply line.

7. An automatic flushing and draining reservoir as claimed in claim 1 wherein said pump means comprises:

(a) a pump mounted in said tank; and (b) an outlet line extending from said pump to the water distribution plumbing system of said evaporative cooler.

8. An automatic flushing and draining reservoir as claimed in claim 7 wherein said pump extends upwardly from said tank to position the motor of said pump within the floor pan of said cooler.

9. An automatic flushing and draining reservoir as claimed in claim 1 wherein said pump means comprises:

(a) an electrically operated pump;

(b) an outlet line coupled between said pump and the water distribution pumping system of said evaporative cooler; and (c) means in the power supply line of said pump for periodically interrupting power to said pump.

10. An automatic flushing and draining reservoir as claimed in claim 9 wherein said means for interrupting power comprises a timing and delay means mounted in the power line of said pump for interrupting current flow at predetermined intervals.

11. An automatic flushing and draining reservoir as claimed in claim 9 wherein said means for interrupting power comprises:

(a) a normally closed solenoid in the power line of said pump; and (b) conductivity sensing means in the power line of said solenoid and in contact with the water in said tank for energizing said solenoid when the conductivity of the water in said tank reaches a predetermined amount.

* * * * *